US006273000B1

(12) United States Patent
Lamoreaux

(10) Patent No.: US 6,273,000 B1
(45) Date of Patent: Aug. 14, 2001

(54) RAIL SWITCHING SYSTEM

(75) Inventor: Ben C. Lamoreaux, Cedar City, UT (US)

(73) Assignee: Aerobus International, Inc., Houston, TX (US)

( * ) Notice: Subject to any disclaimer, the term of this patent is extended or adjusted under 35 U.S.C. 154(b) by 0 days.

(21) Appl. No.: 09/315,868

(22) Filed: May 20, 1999

(51) Int. Cl.[7] ..... E01B 25/12

(52) U.S. Cl. ..... 104/130.01; 104/130.05; 104/100

(58) Field of Search ..... 104/130.01, 130.03, 104/130.05, 130.06, 103, 89, 95, 96, 102, 100, 101

(56) References Cited

U.S. PATENT DOCUMENTS

| | | | | |
|---|---|---|---|---|
| 1,286,042 | * | 11/1918 | McClure et al. | 104/130.01 |
| 3,106,898 | * | 10/1963 | Prosin | 104/130.01 |
| 3,785,294 | * | 1/1974 | Omar | 104/130.01 |
| 3,791,306 | * | 2/1974 | Wagner et al. | 104/130.01 |
| 3,818,836 | * | 6/1974 | Swilley | 104/100 |
| 4,016,818 | | 4/1977 | Ellzey | 104/103 |
| 4,109,584 | | 8/1978 | Mihirogi | 104/130 |
| 4,919,055 | | 4/1990 | Hora | 104/130 |
| 4,920,891 | * | 5/1990 | Loomer | 104/102 |
| 4,970,965 | | 11/1990 | Burg et al. | 104/130 |
| 4,993,326 | | 2/1991 | Bergemann | 104/89 |
| 5,219,395 | * | 6/1993 | Spieldiener et al. | 104/130.01 |
| 5,325,789 | * | 7/1994 | Tapias | 104/130.01 |
| 5,499,583 | | 3/1996 | Blümel | 104/130.03 |
| 5,657,696 | | 8/1997 | Bishop | 14/130.05 |
| 5,829,336 | * | 11/1998 | Schulze | 91/365 |

* cited by examiner

*Primary Examiner*—S. Joseph Morano
*Assistant Examiner*—Lars A. Olson
(74) *Attorney, Agent, or Firm*—Bracewell & Patterson L.L.P.

(57) ABSTRACT

A system for switching rails that rotates in a horizontal plane about a pivot to direct a vehicle traversing a system of rails along alternate paths is provided. The rail switching system also has a main line connector for providing one vehicle path between two segments of a main line. The rail switching system has a branch line connector for providing an alternate vehicle path between a segment of the main line and a branch line segment. The main line connector and branch line connector are fixed relative to one another and rotate about the pivot as a single unit.

22 Claims, 6 Drawing Sheets

RAIL SWITCHING SYSTEM

BACKGROUND OF THE INVENTION

1. Field of the Invention

This invention pertains to rail switches for track-guided vehicles. More particularly, the invention pertains to a system for switching rails that directs a track-guided vehicle along alternate paths by positioning alternate connector tracks to form alternate paths for the vehicle. The alternate connector tracks are fixed relative to one another and pivot about a single pivot point relative to main tracks on which the vehicle operates. When rotated to alternate positions, the respective connector tracks define alternate preselected paths on which the vehicle will travel.

2. Description of the Prior Art

Rail switching devices are well known in the art. The primary objectives of devices disclosed in the art have typically been to provide efficient and reliable switching operations and smooth operating surfaces, and to minimize space requirements for the operation and storage of a switch. A typical rail switch provides a path for a vehicle to traverse along a main line, and upon operation of the switch, activates engagement with a secondary or branch line path onto which the vehicle is diverted. Upon a reverse operation of the switch, the track is reconfigured to again provide a path along the main line over which the vehicle can operate.

The prior art discloses four basic methods of switching: sliding, roll-over, lateral translation, and swinging. U.S. Pat. No. 4,109,584 illustrates switching by sliding. The patent provides for switching by sliding two separate sections of tracks at the switching location. The patent teaches this two part switching mechanism to avoid the great weight of a single switch of the size required. The patent recognizes that an even larger number of switch components or segments would reduce the weight per segment further. However, the patent also recognizes that such a configuration would require a more intricate control device that would unnecessarily complicate the apparatus. The '584 patent thus reached a compromise with the two segment design.

U.S. Pat. No. 5,499,583 discloses a rail switching apparatus that rolls over about the longitudinal axis of the main line of track. The primary advantage cited by the patent is to shelter certain electrical components of the apparatus when the apparatus is in alternate positions. However, because the apparatus rolls 90° about its longitudinal axis and deposits the unused portions of the switch below the portions of the switch in use, the rail switch also discloses an efficient use of lateral space. Disadvantages of the switch are that it requires a greater than typical amount of vertical clearance, and it requires that a heavy center track section be supported for rotation. Additionally, the rail switch requires hinged outer track sections that must be displaced by the switch when the switch is operated to complete the operation. Thus, when the switch is operated, the outer section of the track not in use must be swung about its hinge out of position. These track hinges are additional operable parts that further complicate the apparatus.

U.S. Pat. No. 4,970,965 discloses a similar roll-over switch. The mechanisms and liabilities of the switch are essentially similar to the operation and liability of the switch disclosed in the '583 patent. However, the rail switch of the '965 patent does not hinge the outer sections of track as the '583 patent discloses. No hinge is required because all of the switching track section are rolled over to perform the switching operation. Additionally, the switch of the '965 patent rolls 180° rather than 90° as disclosed in the '583 patent.

A laterally translating switch is shown in U.S. Pat. No. 5,657,696. The switch is designed to provide the required switching while moving the track to alternate angles of bank. While the design does effectively meet its goal of providing switching positions with appropriate bank, it is not an ideal switch in several other respects. For example, because a whole track section must be both lifted and arcuately moved laterally, a significant vertical clearance is required. Also, a relatively large amount of energy is required to both lift and translate. Moreover, the design requires that the combined track assembly twist and bend as it is moved from one switching position to the other. Such a requirement necessarily causes wear and fatigue of the switch assembly.

A further method of switching rails is by swinging the appropriate switching components into and out of position. U.S. Pat. Nos. 4,993,326, 4,919,055, and 4,016,818 disclose different types of swinging switches. The '326 patent shows a single swinging piece that is hinged to a main line of the system and alternately swings back and forth under the action of the switch between the main line and a branch line. The '055 patent provides a similar arrangement except that the hinge includes partial main line and branch line track segments that are swung or pivoted between operable and inoperable positions to make the desired connection. The '818 patent also discloses hinges to both the main line and the branch line and has two separate rail sections that provide alternate paths upon activation of the switch.

Each of these swinging switches provides hinges on the paths of travel of the vehicles traversing the lines. The hinges therefore necessarily provide obstacles around which the traversing of a vehicle along the lines must be designed. For a vehicle that has wheels that wrap around the rail, such obstacles are unacceptable. The '818 and '055 patents disclose an apparatus that is hinged at multiple locations. Such designs add complexity to the switching mechanism by providing multiple bearing and rotation points that must be installed and maintained.

It is therefore obvious that none of the switches in the prior art provide a rail switching apparatus that is compact, efficient to move, easily maintainable, and quickly operable. Nor does the prior art provide an apparatus that is positively lockable and that makes use of hinge or pivot points clear of the operable track such that the hinges do not interfere with the operation of certain vehicles traversing the track.

OBJECTS AND ADVANTAGES

In response to these deficiencies in the art, it is an object of the present invention to provide an improved pivoting rail switch for directing a vehicle traversing a system of rails along alternate paths.

It is therefore an object of the present invention to provide a rail switching apparatus that is configured to pivot about a single point outside of the plane of the rails, and to efficiently direct a vehicle traversing the associated tracks among the associated tracks. Because the switch pivots about a single point, only one bearing must be installed and maintained, and because the pivot is out of the plane of the rails themselves, the pivot imposes no obstruction to the vehicle traversing the tracks.

It is a further object of the present invention that the rail switch operate within a minimal area as compared to similar rail switches that also direct rail segments of the length necessary to effect the proper switching. This is achieved in part by pivoting the switch about a point between the respective ends of the switch whereby ancillary movement, and thus obstruction by parts of the switch not in use in any particular configuration, is minimized.

It is a further object of the present invention that the switch be positively lockable in its alternate positions. A positive lock provides at least two functional advantages. First, the lock prevents the switch from inadvertently swinging into an undesired position. Additionally, by forming a connection between a switching track and the main track, a structural connection between the two tracks is formed. The structural connection also reduces the requirement for additional superstructure to support the switching track near the lock.

It is a further object of the present invention that the switch be operable by an efficient and quickly operating actuator to enhance the effective operation of the switch. The use of a dual action hydraulic cylinder as disclosed herein provides efficient and quick operation.

Further objects and advantages of the present invention will become apparent from a consideration of the drawings and ensuing description.

SUMMARY OF THE INVENTION

The features described above, as well as other objects and advantages, are provided by an improved system for switching rails to direct a vehicle traversing a system of rails along alternate paths. The rail switching system pivots in a horizontal plane about a single point. The system is switched between two alternate positions to direct the vehicle along either a main line connector rail between two segments of a main rail line, or along a branch line connector rail between one of the main line segments and a segment of a branch line. By this arrangement, the invention enables vehicles to either be directed along the main line or diverted from the main line onto a branch line segment. The main line connector rail and the branch line connector rail are both connected to a rail support body that is in turn rotatably engaged to a pivot structure. The pivot is supported by additional superstructure that is beyond the scope of the present invention.

In a preferred embodiment of the present invention, the pivot is located at a point near the end of the system nearest the branch line segment. By pivoting about this point ancillary movement, and thus obstruction by parts of the system not in use in either configuration, is minimized.

Because of the advantageous shapes and orientation of the branch line connectors, main line connectors, and the pivot structure, the rail switching system is able to operate efficiently within a relatively small horizontal area. Furthermore, the vertical distance required for operation of the switch is absolutely minimized.

In a preferred embodiment of the present invention, the end of the rail system nearest the one segment of the main line is vertically supported. The vertical support is free to move horizontally. Preferably, the horizontally movable vertical support is a roller supported on a rail segment. The rail segment is oriented transverse to the longitudinal axis of the main line segments substantially along a radial arc about the pivot.

In a preferred embodiment of the present invention, the main line connector rail is a straight rail that connects between the two main line segments. In this embodiment, the branch line connector rail is a compound curved rail that connects the one main line segment to the branch line segment.

In alternate embodiments, the branch line connector rail is a curved rail, or the branch line connector rail is a straight rail that meets the one main line segment at an angle.

In a preferred embodiment of the present invention, a dual action hydraulic cylinder is connected at one of its ends between the components of the rail switching system. The other of the hydraulic cylinder's ends is connected to a member that is fixed relative to the segments of the main line, such as a member of the superstructure supporting the rail switching system. By actuation of the hydraulic cylinder, the system is rotated about its pivot to move the connector rails to their appropriate positions.

In a preferred embodiment of the present invention, a lock actuated by a dual action hydraulic cylinder is connected to the one segment of the main line. When extended, the lock is positioned to engage either the main line connector rail or the branch line connector rail. By engaging with either connector rail, the lock prevents the system from rotating relative to the branch line segment. Additionally, the lock provides supplemental structural support between the one segment of the main line and either connector rail.

DETAILED DESCRIPTION OF THE INVENTION

Figure 1:
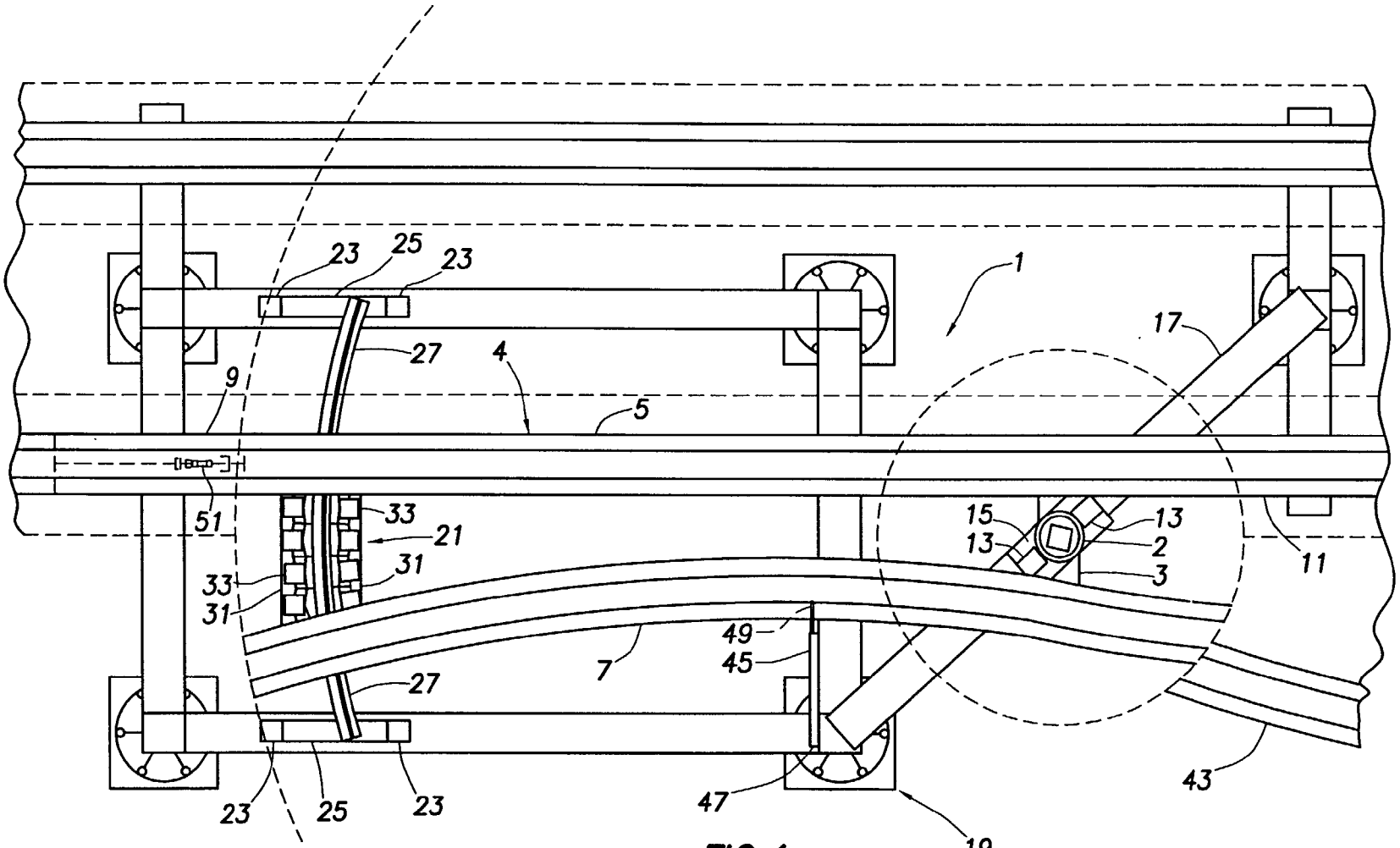
FIG. 1 is a plan view of a rail switching system in accordance with the present invention wherein a main line connector is positioned to connect segments of the main line.
Figure 3:
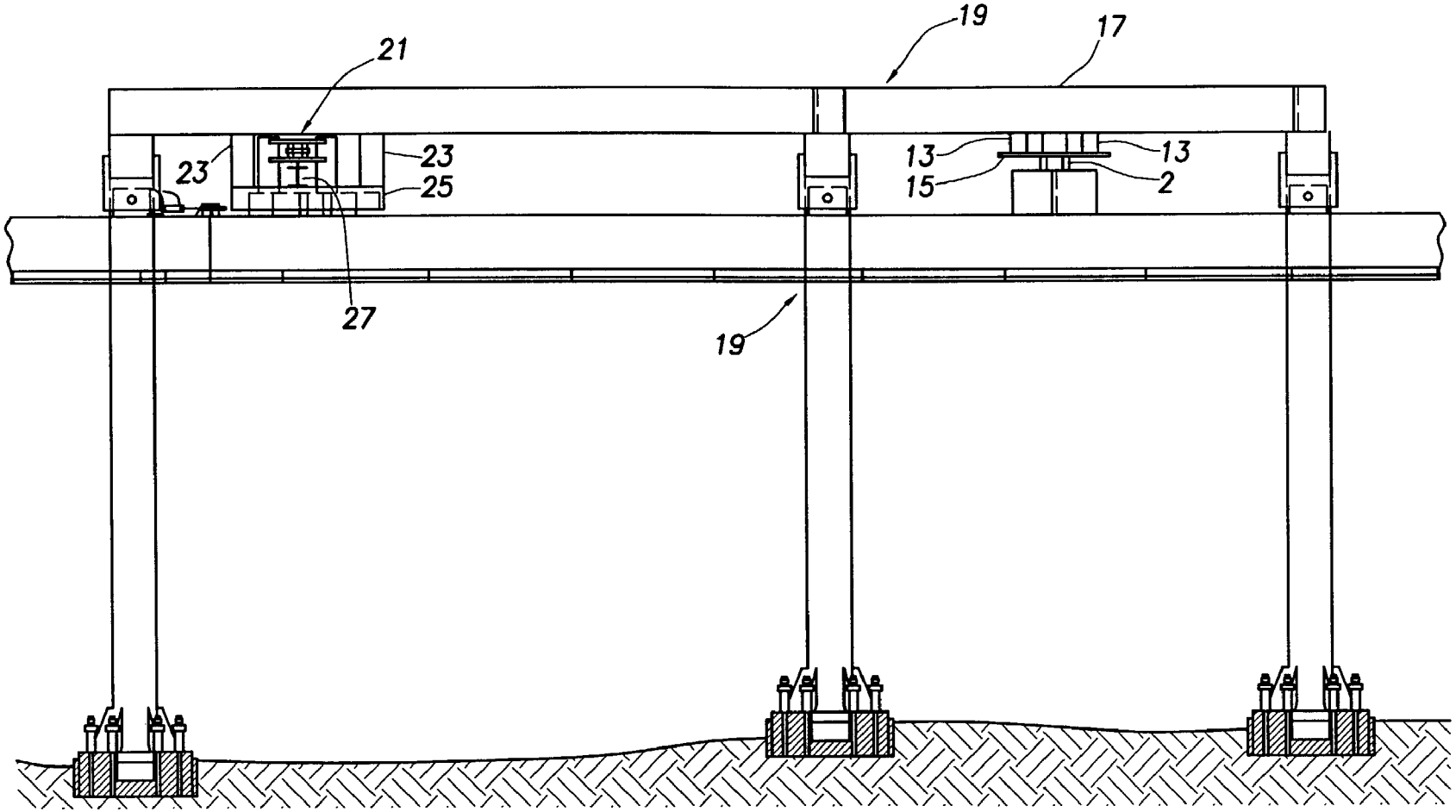
FIG. 3 is a side elevation view of the rail switching system supported on top of a superstructure.
Figure 4:
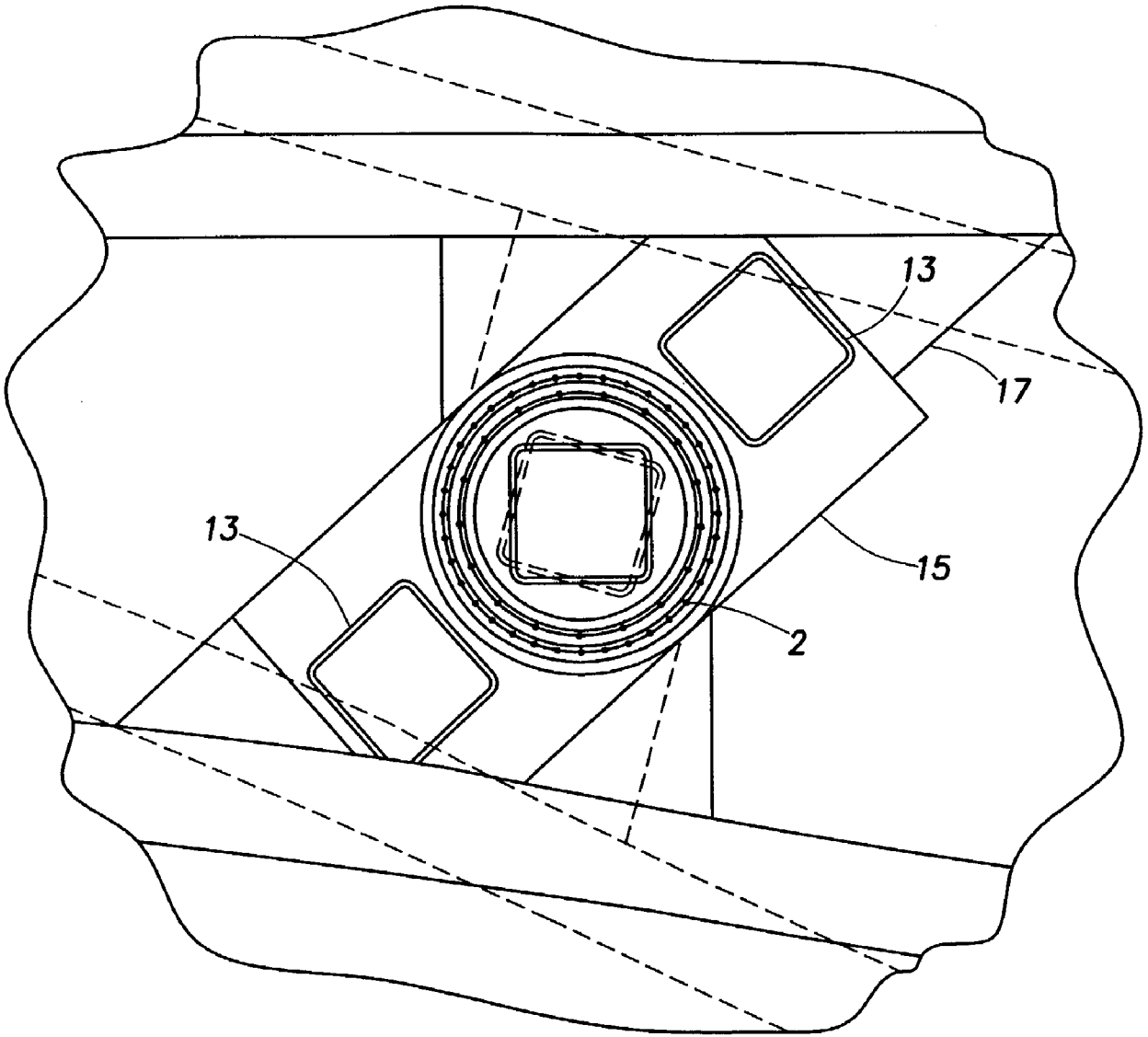
FIG. 4 is a plan view of a detail of the pivot structure for the rail switching system.

FIG. 1 shows rail switching system 1 in accordance with the present invention, positioned such that main line connector rail 5 completes a connection of first main line segment 9 with second main line segment 11. Main line connector rail 5 and branch line connector rail 7 are connected together by rail support body 3 in such a manner that the two connector rails move as a composite assembly. Rail Support body 3 is connected to pivot 2. Pivot 2, as better shown in FIGS. 3 and 4, is suspended from beam 17 by hangers 13 and truss plate 15. This arrangement enables system 1 to rotate about pivot 2 relative to superstructure 19. Superstructure 19 broadly includes all beams, columns, hangers, connections, etc. used to support rail switching system 1.

Figure 5:
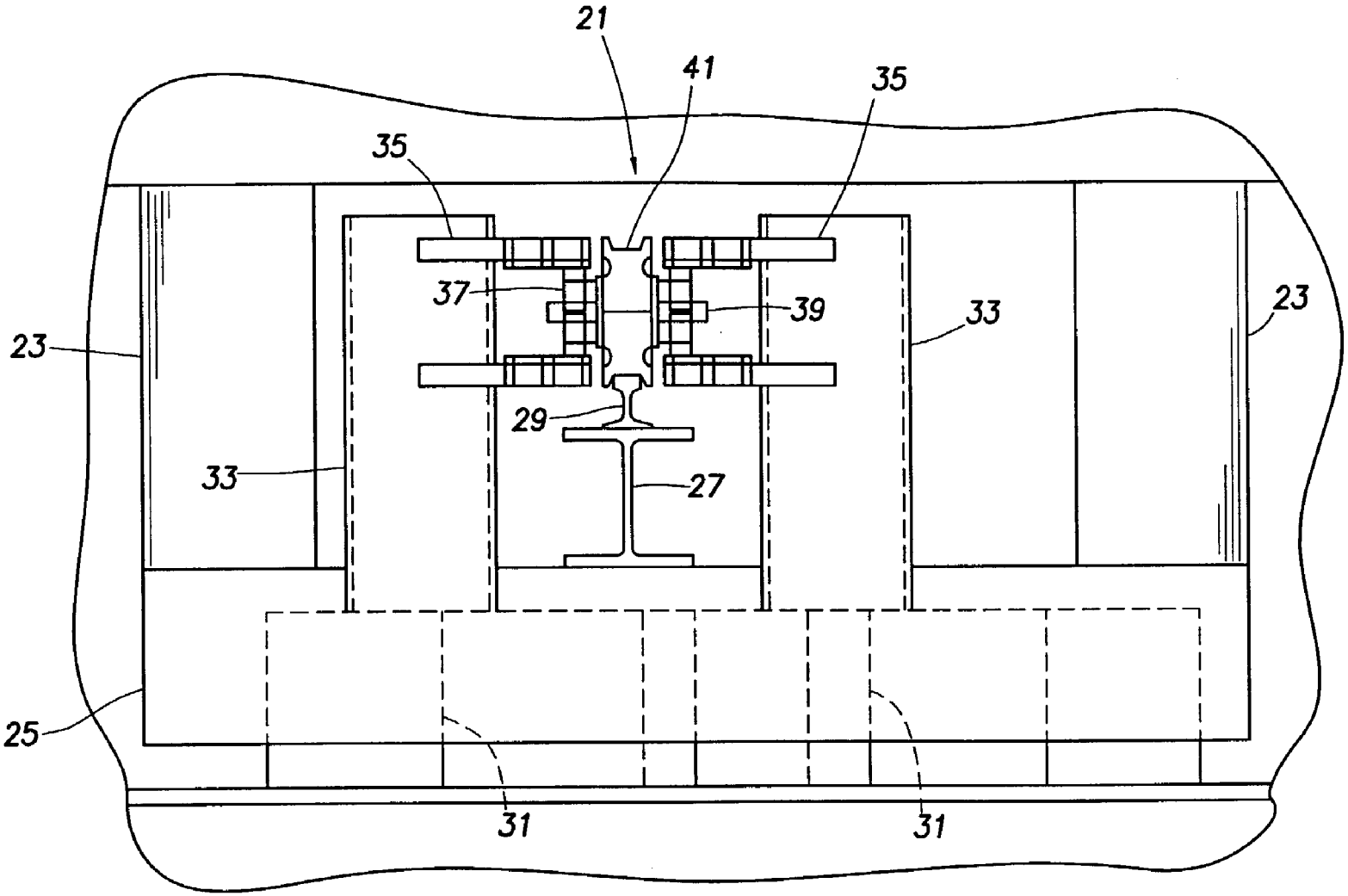
FIG. 5 is an elevation view of a vertical support roller at one end of the rail switching system.

Referring now to FIGS. 1, 3, and 5, the end of system 1 opposite from pivot 2 is vertically supported on roller system 21. Roller system 21 is in turn supported from superstructure 19 by hangers 23, support beams 25, curved beam 27, and curved crane rail 29. Pairs of hangers 23 are suspended from superstructure 19 at positions on both sides of main line 4. Pairs of hangers 23 support beams 25. Curved beam 27 spans between support beams 25. Curved crane rail 29 is attached to the top of curved beam 27 to provide a surface on which roller system 21 can operate. Roller system 21 includes a plurality of roller connections attached to main line connector rail 5 and branch line connector rail 7. Each roller connection attaches to system beams 31 by hangers 33. Hangers 33 are connected to struts 35 which in turn are connected to bearing assemblies 37. Axles 39 are rotatably supported by bearing assemblies 37. Axles 39 are the rotational centers of wheels 41 which run over curved crane rail 29. By this mechanism, upon operation of system 1, wheels 41 roll along curved crane rail 29 and system 1 is vertically supported although allowed to move horizontally to an alternate position.

Figure 2:
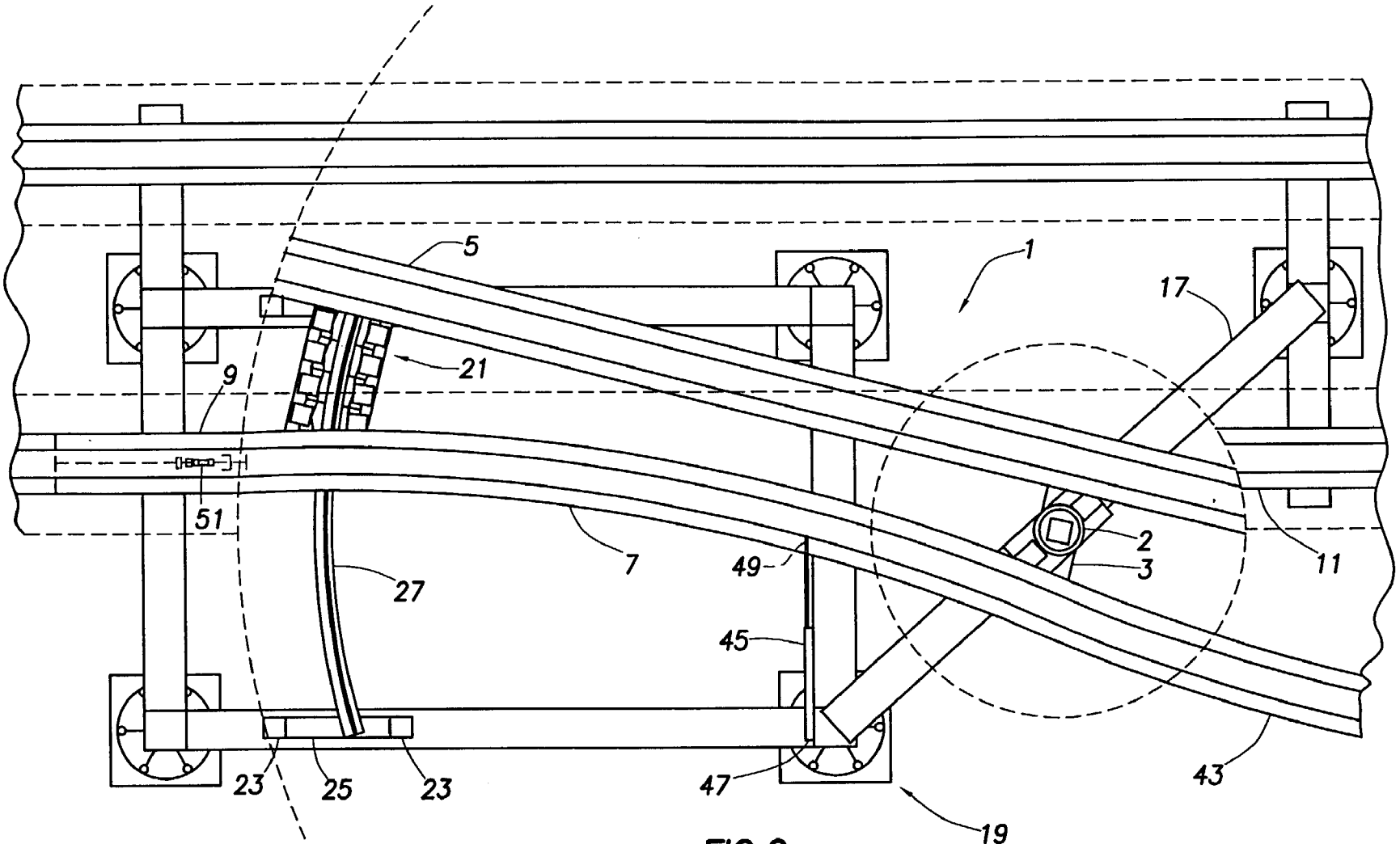
FIG. 2 is a plan view of the rail switching system wherein the system is in position for a branch line connector to connect a segment of the main line with a segment of a branch line.

FIG. 2 shows rail switching system 1 positioned such that branch line connector rail 7 completes a connection of first main line segment 9 with branch line segment 43. With rail switching system 1 in the alignment shown, a vehicle traversing on the rail system will travel between the main line and the branch line operation of actuator 45 results in movement of rail switching system 1 between the alternate positions shown in FIGS. 1 and 2.

Actuator 45 is connected to superstructure 19 at end 47. End 49 of actuator 45 is connected to branch line connector rail 7 which is connected through support body 3 to main line connector rail 5 to form a composite assembly. Therefore, extension and retraction of actuator 45 causes relative movement between superstructure 19 and the composite assembly. When actuator 45 is retracted, main line 4 is completed between first main line segment 9 and second main line segment 11 through main line connector rail 5 as shown in FIG. 1. When actuator 45 is then extended, the composite assembly rotates about pivot 2 and rolls on roller system 21 along curved crane rail 29 to connect branch line segment 43 with first main line segment 9, as indicated in FIGS. 2 and 5. The connection is made along branch line connector rail 7. Subsequent movement of system 1 between the two alternate positions results from subsequent retraction and extension of actuator 45.

Figure 6:
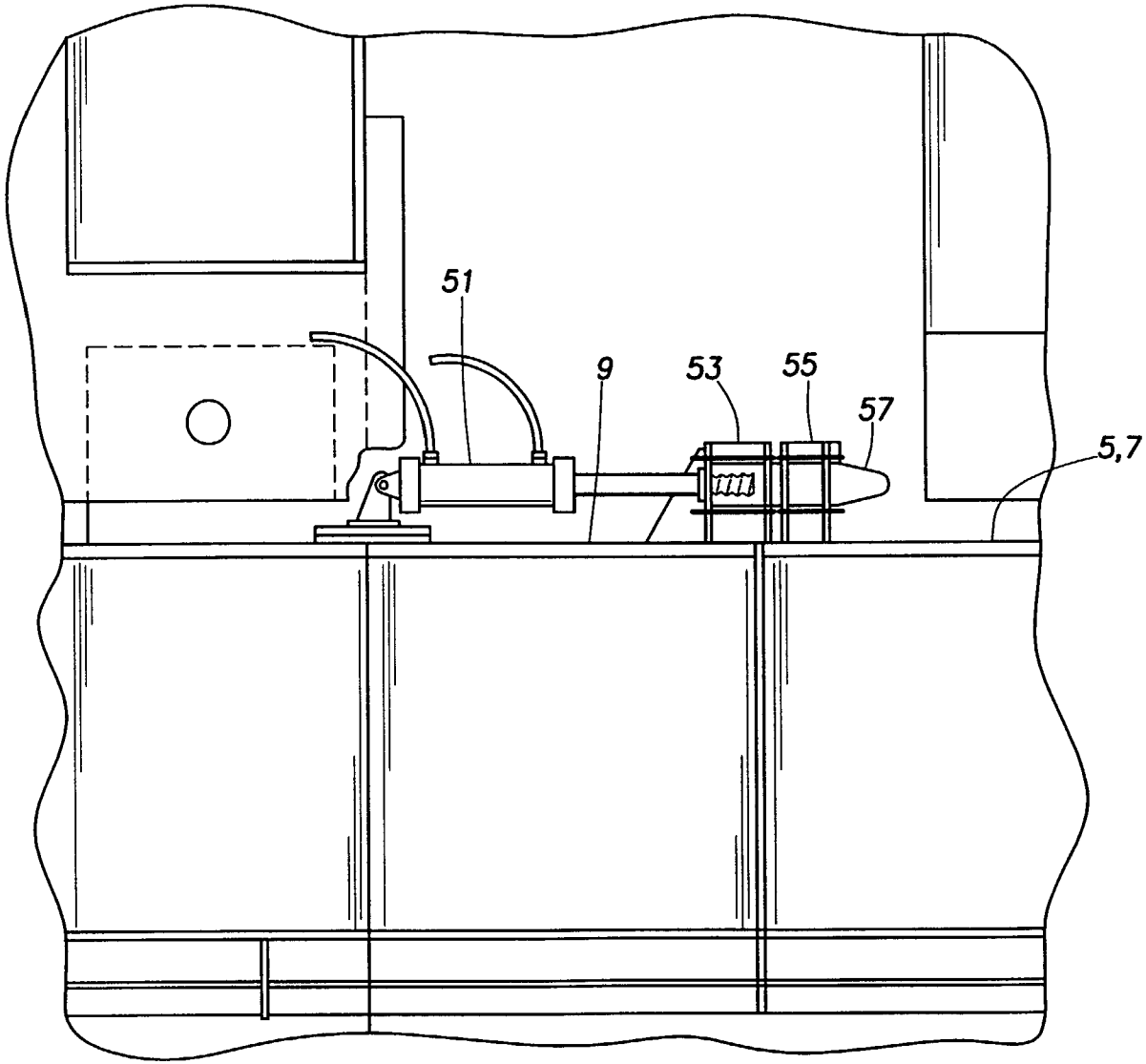
FIG. 6 is an elevation view of a lock for securing the rail switching system to one segment of the main line.

Referring now to FIGS. 1, 2, and 6, a lock is provided to connect main line connector rail 5 or branch line connector rail 7 to first main line segment 9. The lock serves to prevent unwanted rotation of switching system 1 and to provide structural support between main line segment 9 and rails 5 or 7. The lock is engaged by actuator 51 that is connected at its base to first main line segment 9. At its reciprocating end, actuator 51 is fitted with engaging probe 57. Engaging probe 57 is guided by connector tab 53, as shown particularly in FIG. 6. Connector tab 53 is fixed to first main line segment 9. Both rails 5 and 7 are fitted with probe receiving tabs 55.

When rail 5 or 7 is rotated into either alternate position, as shown in FIGS. 1 and 2, probe receiving tab 55 is aligned with connector tab 53 and engaging probe 57. Upon extension of actuator 51, engaging probe 57 slides into receiving tab 55 as shown in FIG. 6. In this position, rail switching system 1 is locked in place. Shear and moment forces are transferred between first main line segment 9 and rail 5 or 7 through tabs 53 and 55 and engaging probe 57. A retraction of actuator 51 withdraws engaging probe 57 from receiving tab 55 and rail switching system 1 is free to rotate. Therefore, locking and releasing of system 1 can be accomplished efficiently and quickly by merely extending and retracting actuator 51.

What is claimed is:

1. A system for switching rails that pivots in a horizontal plane about a single point for directing a vehicle traversing a system of rails along alternate paths comprising:

a pivot for enabling horizontal pivotal movement of said system for switching rails;

a rail support body attached to said pivot for fixing a plurality of rails together and for fixing the plurality of rails to said pivot;

a main line connector rail attached to said rail support body for providing a path for the vehicle traversing the system from one segment of a main line to a second segment of the main line; and a branch line connector rail attached to said rail support body for providing a path for the vehicle traversing the system from the one segment of said main line to a segment of a branch line and said pivot is located at a point near an end of said system near the segment of the branch line and said system is vertically supported by a horizontally movable support near its end near the one segment of the main line.

2. The system for switching rails of claim 1 wherein the horizontally movable support is a roller.

3. The system for switching rails of claim 2 wherein the roller is adapted to roll along a transverse rail segment placed radially from said pivot near the one segment of the main line.

4. The system for switching rails of claim 1 wherein said main line connector rail is a substantially straight rail and said branch line connector rail is a compound curved rail.

5. The system for switching rails of claim 1 wherein said main line connector rail is a substantially straight rail and said branch line connector rail is a curved rail.

6. The system for switching rails of claim 1 wherein said main line connector rail is a substantially straight rail and said branch line connector rail is a substantially straight rail.

7. The system for switching rails of claim 1 further comprising an actuator for moving said system between alternate positions.

8. The system for switching rails of claim 7 wherein the actuator is a duel action hydraulic cylinder.

9. The system for switching rails of claim 8 wherein the actuator is connected at one of its ends to said system for switching rails between the pivot and the one segment of the main line and the actuator is connected at its other end to a member fixed relative to the segments of the main line.

10. The system for switching rails of claim 1 further comprising a lock for securing said system upon engagement of the lock.

11. The system for switching rails of claim 10 wherein the lock is connected to the one segment of the main line and engages either said main line connector rail or said branch line connector rail upon actuation to prevent rotation of said system and for providing structural support between the main line or branch line and the rail switch.

12. The system for switching rails of claim 10 wherein the lock is actuated by a duel action hydraulic cylinder.

13. A rail switching apparatus for directing a vehicle traversing a system of rails along alternate paths comprising:

a system for switching rails that pivots in a horizontal plane about a single point for directing the vehicle along the alternate paths;

a main line that communicates with both ends of said system for switching rails for supporting the vehicle along said main line; and a branch line that communicates with one end of said system for switching rails for supporting the vehicle on an alternate path that diverges from said main line and said system for switching rails pivots about a point near the end of said system closest to said branch line and said system for switching rails is vertically supported by a horizontally movable support near its end opposite from said branch line;and an actuator for moving rails of said rail switch between alternate positions; said actuator is connected at one of its ends to said rail switch between the single pivot point and an end of said system opposite from said branch line and the actuator is connected at its other end to a member fixed relative to said main line.

14. The rail switching apparatus of claim 13 wherein the horizontally movable support is a roller.

15. The rail switching apparatus of claim 14 wherein the roller is adapted to roll along a transverse rail segment placed radially from the pivot point near the end of said system opposite from said branch line.

16. The rail switching apparatus of claim 13 wherein said system for switching rails includes:

a substantially straight rail for providing a path along said main line, and a compound curved rail for providing a path between said main line and said branch line.

17. The rail switching apparatus of claim 13 wherein said system for switching rails includes:

a substantially straight rail for providing a path along said main line, and a curved rail for providing a path between said main line and said branch line.

18. The rail switching apparatus of claim 13 wherein said system for switching rails includes:

a substantially straight rail for providing a path along said main line, and a second substantially straight rail for providing a path between said main line and said branch line.

19. The rail switching apparatus of claim 13 wherein the actuator is a duel action hydraulic cylinder.

20. The rail switching apparatus of claim 13 further comprising a lock for securing said system for switching rails upon engagement of the lock.

21. The rail switching apparatus of claim 20 wherein the lock is connected to said main line on the end opposite from said branch line and engages either a rail connecting said main line or a rail connecting said main line to said branch line upon actuation to prevent rotation of said system for switching rails and for providing structural support between said main line and the system for switching rails.

22. The rail switching apparatus of claim 20 wherein the lock is actuated by a duel action hydraulic cylinder.

* * * * *